US009057371B2

(12) United States Patent
Kreuter

(10) Patent No.: US 9,057,371 B2
(45) Date of Patent: Jun. 16, 2015

(54) METHOD FOR VARYING THE DURATION OF A SUPPLY STROKE OF A PUMP ELEMENT, AND A PUMP DEVICE

(75) Inventor: Peter Kreuter, Aachen (DE)

(73) Assignee: META Motoren-und Energie-Technik GmbH, Herzogenrath (DE)

( * ) Notice: Subject to any disclaimer, the term of this patent is extended or adjusted under 35 U.S.C. 154(b) by 294 days.

(21) Appl. No.: 13/577,767

(22) PCT Filed: Jan. 21, 2011

(86) PCT No.: PCT/EP2011/000251

§ 371 (c)(1),
(2), (4) Date: Aug. 8, 2012

(87) PCT Pub. No.: WO2011/098208

PCT Pub. Date: Aug. 18, 2011

(65) Prior Publication Data

US 2012/0301327 A1 Nov. 29, 2012

(30) Foreign Application Priority Data

Feb. 9, 2010 (DE) ..... 10 2010 007 235

(51) Int. Cl.
*F04B 49/20* (2006.01)
*F04B 17/05* (2006.01)

(52) U.S. Cl.
CPC ..... *F04B 49/20* (2013.01); *F04B 17/05* (2013.01)

(58) Field of Classification Search
CPC ..... F04B 49/00; F04B 49/065; F04B 49/20; F04B 17/05; F02M 39/02; F02B 75/06
USPC ..... 417/53, 218, 221; 74/52, 603, 604; 123/192.1, 192.2
See application file for complete search history.

(56) References Cited

U.S. PATENT DOCUMENTS 1,795,916 A * 3/1931 Wildhaber ..... 475/169
3,112,658 A 12/1963 Berlyn
3,507,162 A * 4/1970 Ishijima et al. ..... 475/14

(Continued)

FOREIGN PATENT DOCUMENTS

CN 2066503 U 11/1990
DE 3119388 A1 1/1983

(Continued)

OTHER PUBLICATIONS

International Search Report from parent International application No. PCT/EP2011/000251.

(Continued)

*Primary Examiner* — Devon Kramer
*Assistant Examiner* — Jon Hoffmann
(74) *Attorney, Agent, or Firm* — J-Tek Law PLLC; Jeffrey D. Tekanic; Scott T. Wakeman

(57) ABSTRACT

A pump device is operated according to a method for varying the duration of a supply stroke of a pump element, the supply stroke of which is actuated by a rotatably driven pump shaft (P) over a predetermined rotational position range of the pump shaft. In the method, the pump shaft (P) is rotatably driven by a drive shaft (A) and the angular speed of the pump shaft, at a constant angular speed of the drive shaft, is increased and decreased at least once during one revolution of the pump shaft.

19 Claims, 7 Drawing Sheets

(56) References Cited

U.S. PATENT DOCUMENTS

| | | | | | |
|---|---|---|---|---|---|
| 4,170,438 | A | * | 10/1979 | Kondo et al. | 417/223 |
| 4,481,918 | A | | 11/1984 | Morton | |
| 4,979,476 | A | | 12/1990 | Islas | |
| 5,083,535 | A | | 1/1992 | Deschler et al. | |
| 5,758,615 | A | | 6/1998 | Kreuter | |
| 5,794,493 | A | | 8/1998 | Bollig et al. | |
| 6,892,997 | B2 | | 5/2005 | Kreuter | |
| 6,923,151 | B2 | | 8/2005 | Kreuter | |
| 7,055,470 | B2 | | 6/2006 | Kreuter et al. | |
| 7,080,631 | B2 | * | 7/2006 | Hanyu | 123/495 |
| 7,464,800 | B2 | | 12/2008 | Nerubenko | |
| 8,701,616 | B2 | * | 4/2014 | Kreuter et al. | 123/192.2 |
| 2002/0117155 | A1 | * | 8/2002 | Takeda et al. | 123/509 |
| 2009/0007979 | A1 | * | 1/2009 | Isono et al. | 138/30 |
| 2011/0083631 | A1 | | 4/2011 | Kreuter et al. | |

FOREIGN PATENT DOCUMENTS

| | | | | | |
|---|---|---|---|---|---|
| DE | 4115811 | A1 | | 11/1991 | |
| DE | 19649712 | A1 | | 6/1998 | |
| FR | 2565655 | A1 | | 12/1985 | |
| GB | 2039601 | A | * | 12/1978 | F02D 1/02 |
| GB | 2039601 | | | 8/1980 | |
| GB | 2039601 | A | * | 8/1980 | |
| JP | 03-219144 | | | 9/1991 | |
| JP | 03-265737 | | | 11/1991 | |
| JP | 06-341491 | | | 12/1994 | |
| WO | 2006/106891 | | | 10/2006 | |
| WO | 2008/145342 | | | 12/2008 | |

OTHER PUBLICATIONS

Non-final Office Action mailed Jul. 29, 2013 in related U.S. Appl. No. 12/602,470.

Notice of Allowance mailed Dec. 20, 2013 in related U.S. Appl. No. 12/602,470.

English translation of International Preliminary Report on Patentability from parent International application No. PCT/EP2011/000251.

Office Action from Chinese Patent Office mailed Aug. 5, 2014 in counterpart CN patent application No. 201180008764.X.

* cited by examiner

METHOD FOR VARYING THE DURATION OF A SUPPLY STROKE OF A PUMP ELEMENT, AND A PUMP DEVICE

CROSS-REFERENCE

This application is the U.S. national stage of International Application No. PCT/EP2011/000251 filed on Jan. 21, 2011, which claims priority to German patent application no. 10 2010 007 235.4 filed on Feb. 9, 2010.

TECHNICAL FIELD

The invention relates to a method for varying the duration of a supply stroke of a pump element, the supply stroke of which is actuated by a rotatably-driven pump shaft over a predetermined rotational position range of the pump shaft. The invention further relates to a pump device for performing the method.

RELATED ART

Distributor injection pumps, in particular distributor injection pumps for diesel engines with direct injection, are known. In such distributor injection pumps, in general a pump shaft is driven by the crankshaft of an internal combustion engine, which pump shaft drives a pre-supply pump contained in a housing and a high-pressure pump connected downstream of the supply pump. The high-pressure pump contains a single pump element, which is formed as a distributor piston, which carries out a rotational motion as well as a stroke motion and in the sequence of its rotation is sequentially connected with outlets leading to individual cylinders of the internal combustion engine via a distributor.

A peculiarity of the distributor injection pumps is that the injection pressure depends on the rotational speed of the pump shaft and for example increases linearly or even exponentially with the rotational speed. This means a low injection pressure at low engine rotational speeds and a high injection pressure at high engine rotational speeds. The injection pressure, which is available at the injection valves that in general open against a spring force, is an important operating parameter having a strong influence on emissions and torque.

SUMMARY

It is an object of the present teachings to disclose an injection pump, whose supply speed and/or supply injection pressure can be held at an at least substantially constant value and, if necessary, at a relatively high value, independent of the rotational speed of a drive shaft of the injection pump.

In one aspect of the present teachings, a kinematic transmission is preferably disposed between the pump shaft, whose angular speed and/or rotational speed determines the supply speed and/or the duration of the stroke of one or more pump elements, and a drive shaft, with which the pump shaft is driven, which kinematic transmission makes it possible to increase or decrease the angular speed of the pump shaft, as required, for a drive shaft that rotates at a constant rotational speed or angular speed within the rotational position ranges of the pump shaft; a supply stroke or a fluid supply cycle, for example liquid fuel, takes place within the rotational position ranges.

The invention is suitable for substantially all types of pumps or pump devices, in which a predetermined volume of fluid is supplied to an outlet conduit over a rotational position range of a rotatably-driven pump shaft of a pump element, which is moved by the pump shaft.

With the assistance of schematic drawings, the invention will be explained below in an exemplary manner and with further details.

DETAILED DESCRIPTION OF THE INVENTION

Figure 1:
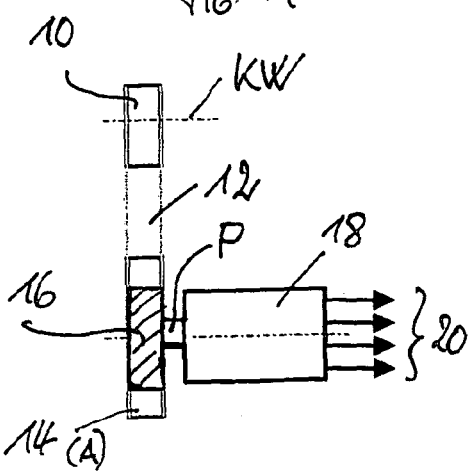
FIGS. 1 to 3 depict principle views of three different embodiments of an inventive pump device.

According to FIG. 1, a crankshaft KW of an internal combustion engine has a disk 10 connected so as to rotate with it, which disk 10 is connected with a further disk 14 via an endless belt/chain means 12 or one or more toothed gears. The disk 14 is borne coaxially relative to a pump shaft P and is connected with the pump shaft via a kinematic transmission 16, which will be described in more detail below. The disk 14 thus forms a drive shaft A for the pump shaft P. Depending on the construction of an injection pump 18, the pump shaft P drives one or more pump elements. In a distributor injection pump, the pump shaft drives a stroke motion and a rotation of a single pump piston serving as a pump element in a known manner; the pump piston supplies fuel to each one of multiple outlets 20 in predetermined rotational position ranges that are spaced equidistant from one another in the direction of rotation; the outlets 20 are each connected with a respective injection valve of an internal combustion engine via respective outlet and/or pressure conduits. If the injection pump 18 is formed as an in-line injection pump, the pump shaft P includes for example multiple cams that are spaced in the axial direction and are offset relative to each other in the circumferential direction of the pump shaft; a pump element serving as a piston executes a supply stroke in accordance with the contour of the respective cam. Each of the pistons operates in a single cylinder, each of which is connected via a pressure conduit with one of the multiple outlets 20 of the injection pump 18.

Overall, as the pump shaft P rotates, the individual outlets 20 are sequentially loaded with fuel supplied by the pump element or the pump elements during predetermined rotational position intervals of the pump shaft P, wherein without taking additional measures, the amount of fuel supplied in accordance with the rotation of the pump shaft is independent of the rotational speed of the pump shaft; however, with increasing rotational speed of the pump shaft, the supply duration, i.e. the period of time within which a predetermined amount of fuel is supplied, becomes shorter, and the supply speed, i.e. the speed of the pump element when executing a supply stroke, increases. In this way, a pressure resulting at a throttle point or an inlet of an injector valve generally increases with increasing rotational speed of the pump shaft P.

Figure 2:
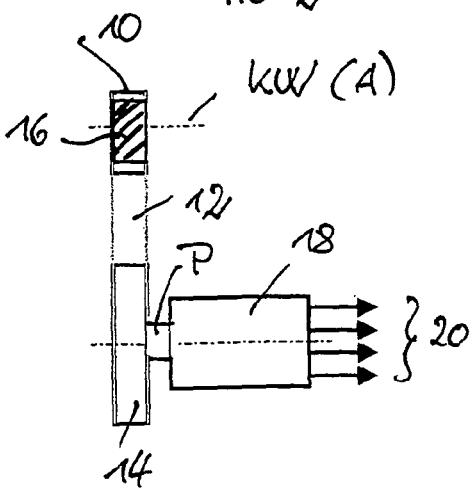

FIG. 2 shows an embodiment modified relative to FIG. 1, wherein the kinematic transmission 16 is disposed between the crankshaft KW and the disk 10. The crankshaft thus directly forms the drive shaft A for the kinematic transmission 16 and the pump shaft P, respectively.

Figure 3:
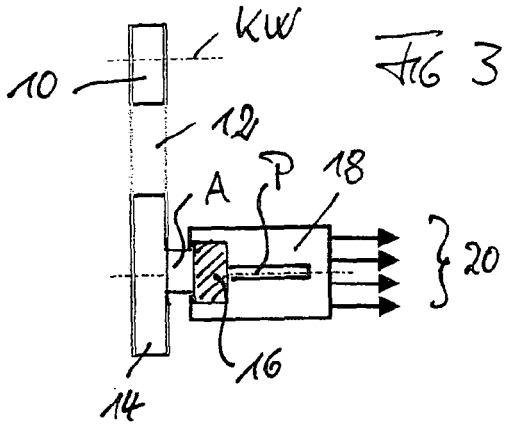

In the embodiment according to FIG. 3, the disk 10, which is connected with the crankshaft KW, is connected with the disk 14 via the endless belt/chain means 12. The disk 14 is connected with a drive shaft A so as to rotate therewith, which drive shaft A is led through a wall of the housing of the distributor injection pump 18 and which drive shaft A is connected with a pump shaft P within the housing of the distributor injection pump 18 via a kinematic transmission 16 to drive the pump element(s) of the distributor injection pump (e.g. the impeller of the rotary vane pump, as well as the distributor piston).

It is assumed that a direct-injection diesel engine has an operating range between 1,000 and 4,000 revolutions per minute of the crankshaft. The drive from the crankshaft to the pump shaft is then such that the pump shaft—for an embodiment of the internal combustion engine as a four-stroke engine—rotates at one-half the rotational speed of the crankshaft, i.e. at a rotational speed between 500 and 2,000 $min.^{-1}$. With a conventional drive of the pump shaft P at one-half the rotational speed of the crankshaft, the pressure acting at the outlets changes in accordance with the rotational speed of the pump shaft between a minimal value of 500 $min.^{-1}$ and a maximal value of 2,000 $min.^{-1}$. This pressure fluctuation makes an optimal layout of the entire injection system more difficult and leads to difficulties with the simultaneous fulfillment of emission regulations and sufficient torque at low rotational speeds.

According to the invention the kinematic transmission 16 is connected upstream of the drive of the pump shaft P, which makes it possible that, at a constant rotational speed of the drive shaft A and/or of an input link of the kinematic transmission 16, the angular speed of the pump shaft P increases and decreases during one rotation of the pump shaft P as often as the outlets 20 associated with the individual cylinders are loaded with supplied fuel or pressure at equal angular intervals of the pump shaft.

The function of the kinematic transmission 16 will be explained with the assistance of FIG. 4 for a pump supplying a four-cylinder engine. The angular position $\Phi$ of the pump shaft is indicated on the abscissa. The ordinate indicates the ratio between instantaneous angular speed $\omega$ of the pump shaft P to an average angular speed $\omega_0$ of the pump shaft, which may be the same as the rotational speed of an input element of the kinematic transmission and/or the rotational speed of its drive shaft. As is apparent in the depicted example, the ratio increases and decreases four times during one revolution. In this way, the angular speed of the pump shaft P can be increased or decreased at the respective injection time point, i.e. at the angular position, at which a respective outlet is loaded with supplied fuel or pressure. Thus at low engine rotational speeds and/or low rotational speeds of the drive shaft or one of the input elements of the kinematic drive 16, the angular speed of the pump shaft during the injection time period increases, whereas it is reduced at high engine rotational speeds. In this way there is the possibility to hold the angular speed of the pump shaft P, which angular speed determines the injection pressure, nearly constant at each injection time point over the engine rotational speed.

In the following, the rotational speed of the drive shaft and/or of the input shaft is designated as the rotational speed, because the angular speed of the drive shaft during one rotation—except for rotational oscillations of the crankshaft—is constant when the crankshaft rotates at a constant rotational speed. The rotational speed of the pump shaft, which changes during one revolution as often as the number of outlets of the pump, is designated as the angular speed.

It is assumed, for example, that the rotational speed of the drive shaft and/or of the input element of the kinematic transmission is one-half of the crankshaft speed of the internal combustion engine (for four-stroke engines). If the minimum operating rotational speed of the internal combustion engine is 1,000 $min.^{-1}$, in the embodiments according to FIGS. 1 and 3 the drive shaft and/or input shaft of the kinematic transmission 16 rotates at 500 $min.^{-1}$. If the injection time point falls in a range in which the ratio $\omega/\omega_0$ is exactly 2, this corresponds to an angular speed of the pump shaft of 1,000 $min.^{-1}$, and an injection pressure is achieved as if the internal combustion engine runs at 2,000 rpm. However, if the internal combustion engine runs at 4,000 $min.^{-1}$, the drive shaft runs at 2,000 $min.^{-1}$. If the injection time point then falls in a range, in which the ratio $\omega/\omega_0$ is 0.5, an injection pressure is achieved, which also corresponds to a rotational speed of the internal combustion engine of 2,000 rpm. Thus, over the entire operating range of the internal combustion engine between 1,000 $min.^{-1}$ and 4,000 $min^{-1}$, a constant injection pressure can be achieved through appropriate adjustment of the kinematic transmission by increasing the angular speed of the pump shaft, which angular speed exists during the injection, in the lower half of the operating rotational speed range or rather below a predetermined rotational speed and by decreasing it above the predetermined rotational speed. More precisely, the angular speed of the pump shaft during the injection increasingly increases or decreases with increasing differences between the instantaneous rotational speed of the drive shaft and a predetermined rotational speed, which for example corresponds to the rotational speed of the drive shaft in the middle of the operating range.

Figure 5:
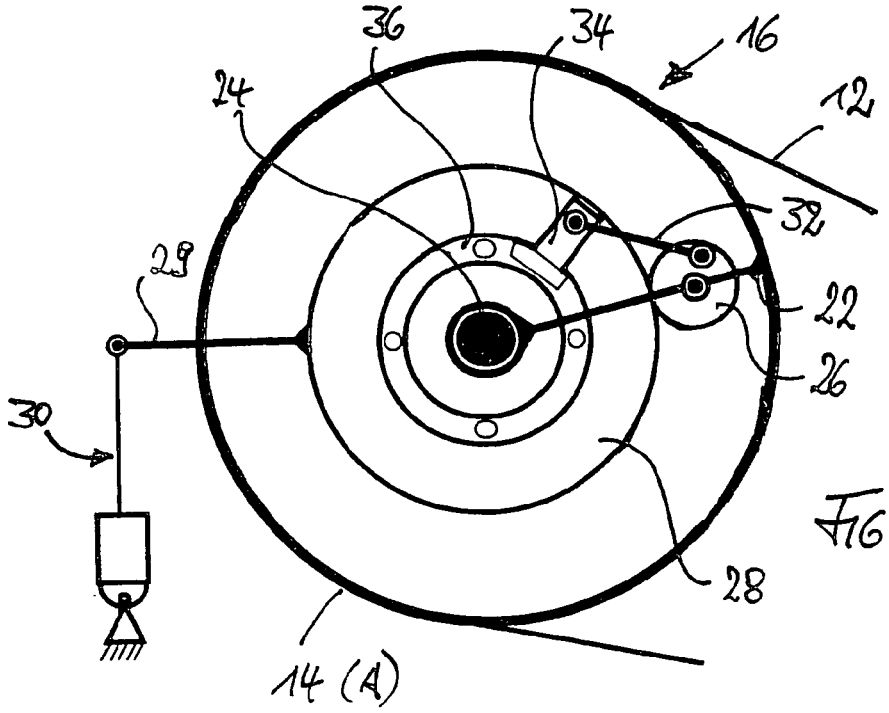
FIGS. 5 to 9 depict principle views of three embodiments of a kinematic transmission.

FIG. 5 shows an example of a kinematic transmission in the arrangement for example according to FIG. 1:

The disk 14 rotatably driven by the endless belt/chain means 12 is rigidly connected with a support rod 22, which is borne on an axle 24 concentric to the rotational axis of the disk 14. A planetary gear 26 is rotatably borne on the support rod 22; the external teeth of the planetary gear 26 mesh with external teeth of a large gear 28, which is disposed concentric to the axle 24 and is rigidly connected with an adjusting arm 29, which is part of an adjusting device 30. The rotational position of the large gear 28 can be adjusted using the adjusting device 30.

Eccentric to the bearing of the planetary gear 26 on the support rod 22, a push rod 32 is borne on the planetary gear 26; the push rod 32 is rotatably borne on an extension 34 at the end of the push rod 32 that faces away from the rotatable bearing at the planetary gear 26; the extension 34 is rigidly connected with an annular part 36, which is rotatable coaxially relative to axle 24 and is connected with the pump shaft P so as to rotate therewith (FIG. 1) or is formed in one piece with the pump shaft P.

If the diameter of the planetary gear 26 for example is one-fourth of the diameter of the large gear 28, the planetary gear 26 rotates about the large gear 28 four times during one full rotation about its axis for its revolution accompanying the rotation of the disk 14, so that the extension 34 advances or retards the support rod 22 four times during one rotation. In this way, during one revolution, four times the annular part 36 or the pump shaft P has a larger angular speed and four times it has a smaller angular speed than the disk 14 and/or the drive shaft A. The amplitude of the increase of the angular speed and the decrease of the angular speed of the pump shaft P relative to that of the disk 14 can be adjusted by changing the length of the push rod 32, by changing the distance of the rotatable support of the push rod 32 to the extension 34 from the rotational axis of the annular part 36 and by changing the distance of the rotatable of the push rod 32 to the planetary gear 26 from its rotational axis. The amplitude of these angular speed changes can be adjusted for example by varying of the last-mentioned distance using a cam. The phase position of the angular speed change of the annular part 36 (of the pump shaft P) relative to the disk 14 (of the crankshaft KW) can be changed by changing the rotational position of the stationary large gear 28 using the adjusting device 30.

Figure 4:
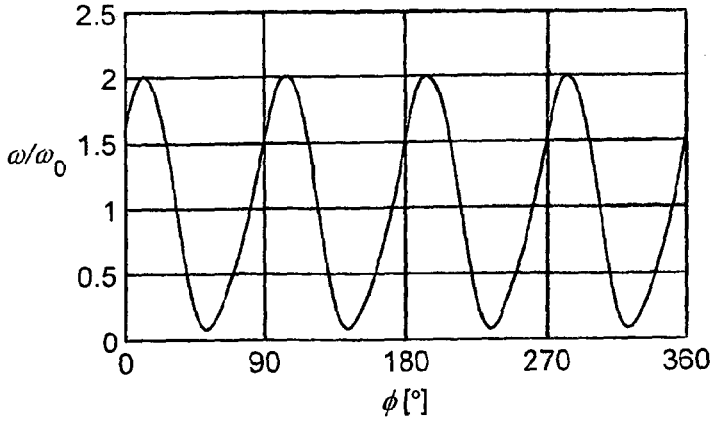
FIG. 4 depicts relative angular speeds of a pump shaft, which is connected with a drive shaft via a kinematic transmission.

Referring to FIG. 4, it is assumed that, at angular positions of the pump shaft P in a range around 0 degrees, 90 degrees, 180 degrees and 270 degrees, each one of the outlets 20 is loaded with a predetermined amount of supplied fuel or fuel pressure, so the curve according to FIG. 4 can be moved in parallel in the horizontal direction by operating the adjusting device 30, because the association between the rotational position of the annular part 36 and the respective increases or decreases of the angular speeds of the annular part 36 is changed. Thus the curve of FIG. 4 can be moved such that, at a particular injection time point, the value $w/\omega_0$ assumes any value between its maximum and its minimum. In this way, at different rotational speeds of the drive shaft and/or the disk 14, the instantaneous angular speed of the annular part 36 and/or the pump shaft P at different rotational speeds of the drive shaft in the respective rotational positions of the pump shaft, in which the outlets of the injection pump are loaded with fuel, can be held at least nearly constant.

Another advantageous possibility, which is made possible with the described kinematic transmission, is as follows: As can be seen from FIG. 5, each adjustment of the adjustment device 30 is accompanied by a change of the rotational position of the annular part 36 or the pump shaft P relative to the rotational position of the disk 14 or the crankshaft KW. If an adjustment of the adjustment device 30 towards a decrease of the angular speed of the annular part 36 at the particular injection time point, as is expedient for holding constant the injection pressure at increasing rotational speeds of the crankshaft, is combined with an adjustment of the rotational position of the annular part 36 relative to the disk 14 such that the rotation of the annular part 36 and therewith the pump shaft P with respect to the rotation of the disk 14 or the crankshaft KW is adjusted in the direction of early, i.e. the pump shaft runs ahead of the crank shaft, is simultaneously connected therewith an early adjustment of the injection time point relative to the rotational position of the crankshaft with increasing rotational speed of the crankshaft, so that a separate adjuster for an earlier adjustment of the injection time point with increasing rotational speeds of the internal combustion engine can be omitted.

Figure 6:
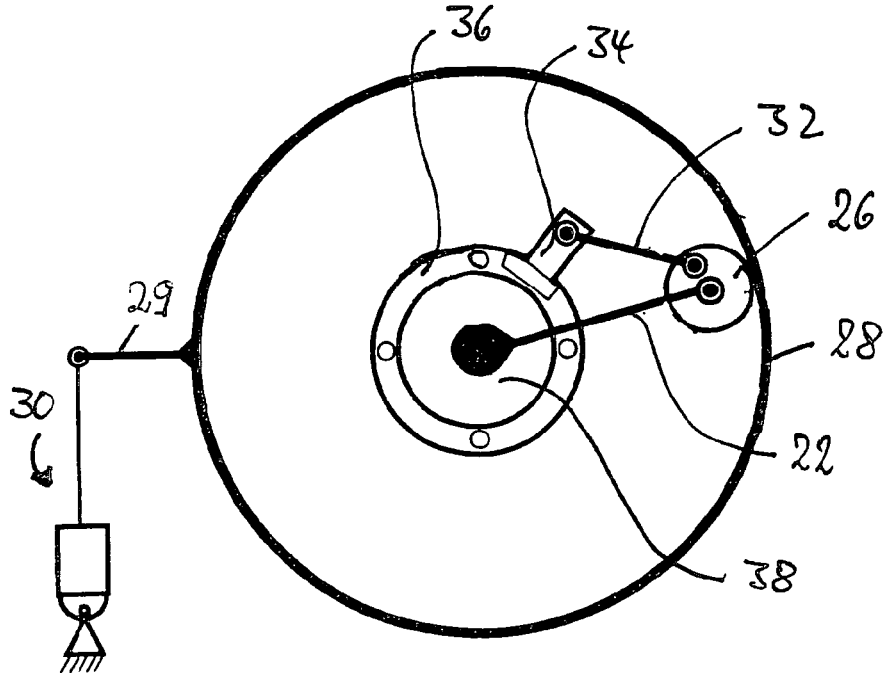

FIG. 6 shows an embodiment of the coupling transmission and/or kinematic transmission, which differs from FIG. 5 only in that the large gear 28 is formed as an internal gear having internal teeth, along which the small planetary gear 26 rotates. In the example of FIG. 6, the ratio of the diameter of the planetary gear 26 to the diameter of the large gear 28 is 1:6, so that the angular speed of the annular part 36 and therewith the pump shaft P increases and decreases six times during one rotation of the planetary gear. In accordance with the diameter ratio of the two gears, the coupling transmission can thus be adapted to internal combustion engines having different numbers of cylinders.

In the embodiment according to FIG. 6, the endless belt/chain means drives a shaft 38, which is connected with the support rod 22 so as to rotate therewith; the planetary gear 26 is rotatably borne on the support rod 22.

Figure 7:
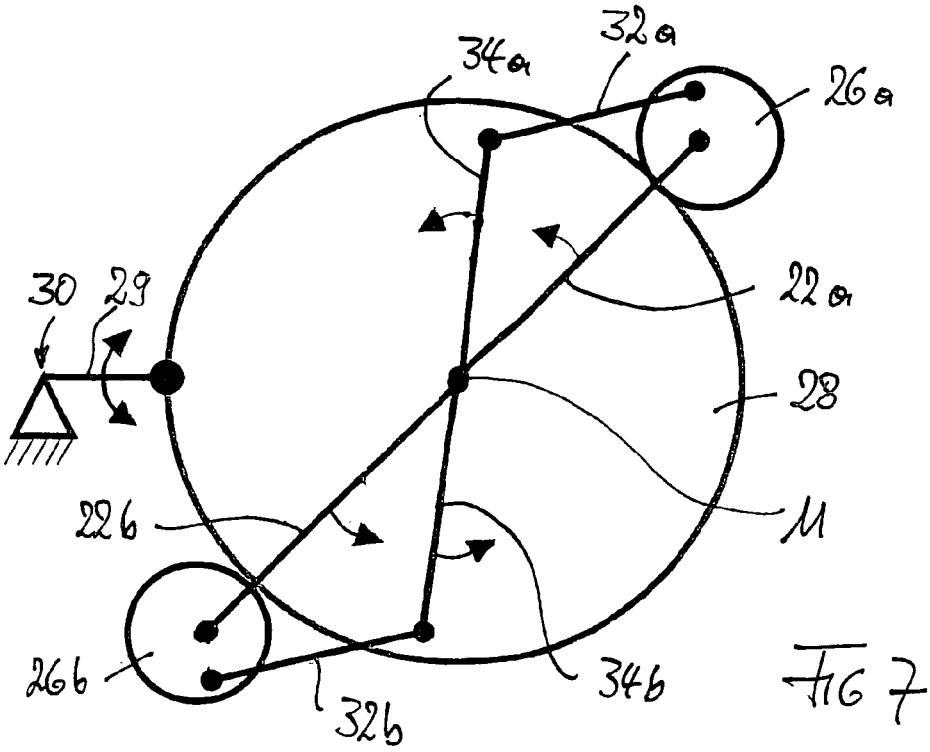

FIG. 7 schematically shows an embodiment of a kinematic transmission, which contains two transmissions according to FIG. 5 and in this way is symmetrically formed. Corresponding components are assigned with the same reference numbers as in FIG. 5; however they are additionally designated with "a" and "b". The support rods 22*a* and 22*b* can be formed together in one piece and are for example connected with an input shaft (not depicted) so as to rotate therewith; the input shaft is rotatable about the midpoint M of the assembly and for example is driven by the crankshaft of the internal combustion engine. The extensions 34*a* and 34*b* are connected, for example with the pump shaft (not depicted in FIG. 7) so as to rotate therewith; the pump shaft is also rotatable about the midpoint M.

It is understood that other forms of a symmetric arrangement of the transmission with more than two (e.g. three or four transmissions according to FIG. 5) are also conceivable, in order to for example reduce the loads on the planetary gears.

Figure 8:
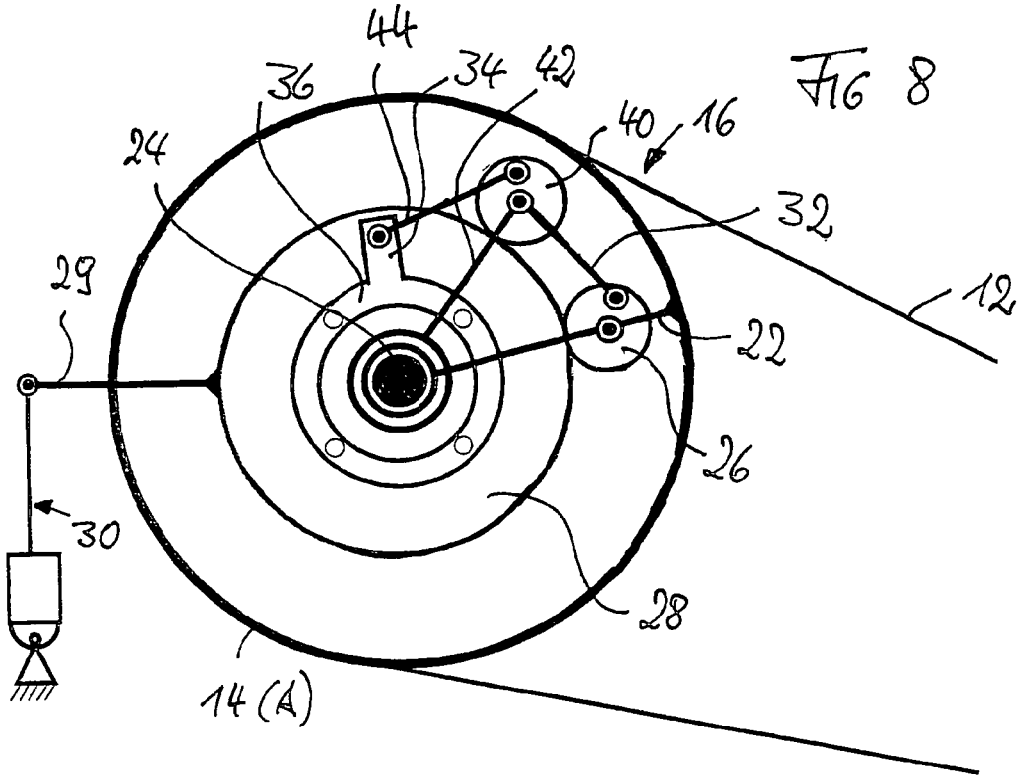

FIG. 8 shows an embodiment modified with respect to FIG. 5, wherein corresponding components are assigned with the same reference numbers and only the modifications will be described:

In the embodiment according to FIG. 8, in addition to the planetary gear 26 a further planetary gear 40 is provided, whose diameter is the same as that of the planetary gear 26 and which is rotatably borne by the guide rod 42, which is rotatably borne about the axle 24, such that its circumferential teeth are in engagement with the external teeth of the gear 28. The push rod 32 is borne coaxially with the guide rod 42 centrally on the further planetary gear 40. A further push rod 44 is borne eccentrically on the further planetary gear 40, the other end of which push rod 44 is borne on the extension 34. As will be explained below with the assistance FIG. 10, the extent of the increase and decrease of the angular speed of the extension 34 relative to the angular speed of the disk 14 and/or the drive shaft A or the crankshaft KW can be increased with the kinematic transmission KW according to FIG. 8.

Figure 9:
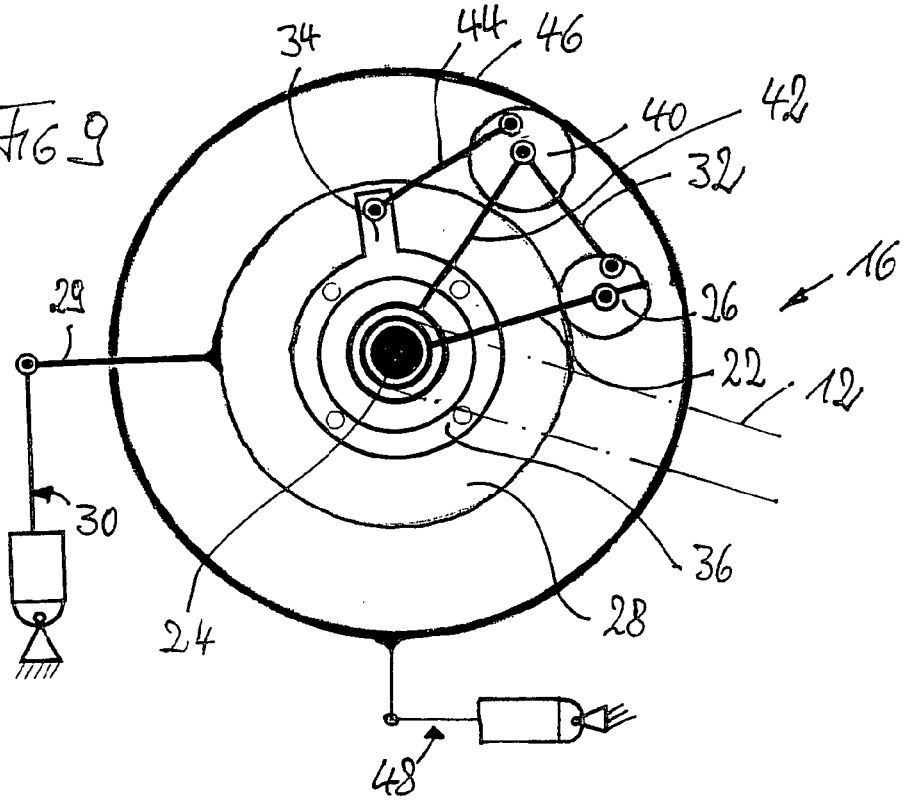

FIG. 9 shows an embodiment of the kinematic transmission 16, which differs from the kinematic transmission 16 of FIG. 8 in the following features:

The further planetary gear 40 does not mesh with the external teeth of the gear 28, but rather with internal teeth of a further gear 46, whose teeth are concentric to the teeth of the gear 28. The diameter of the further planetary gear 40 is larger than that of the first planetary gear 26, so that the rotational speed of both planetary gears is the same. The endless belt/chain means 12 drives a hub of the support rod 22. The support rod 22 is not connected with the further gear 46. The further gear 46 is held rotationally fixed, wherein its rotational position is adjustable using a further adjusting device 48. The function of the kinematic drive according to FIG. 9 will be explained below with the assistance of FIG. 11.

Figure 10:
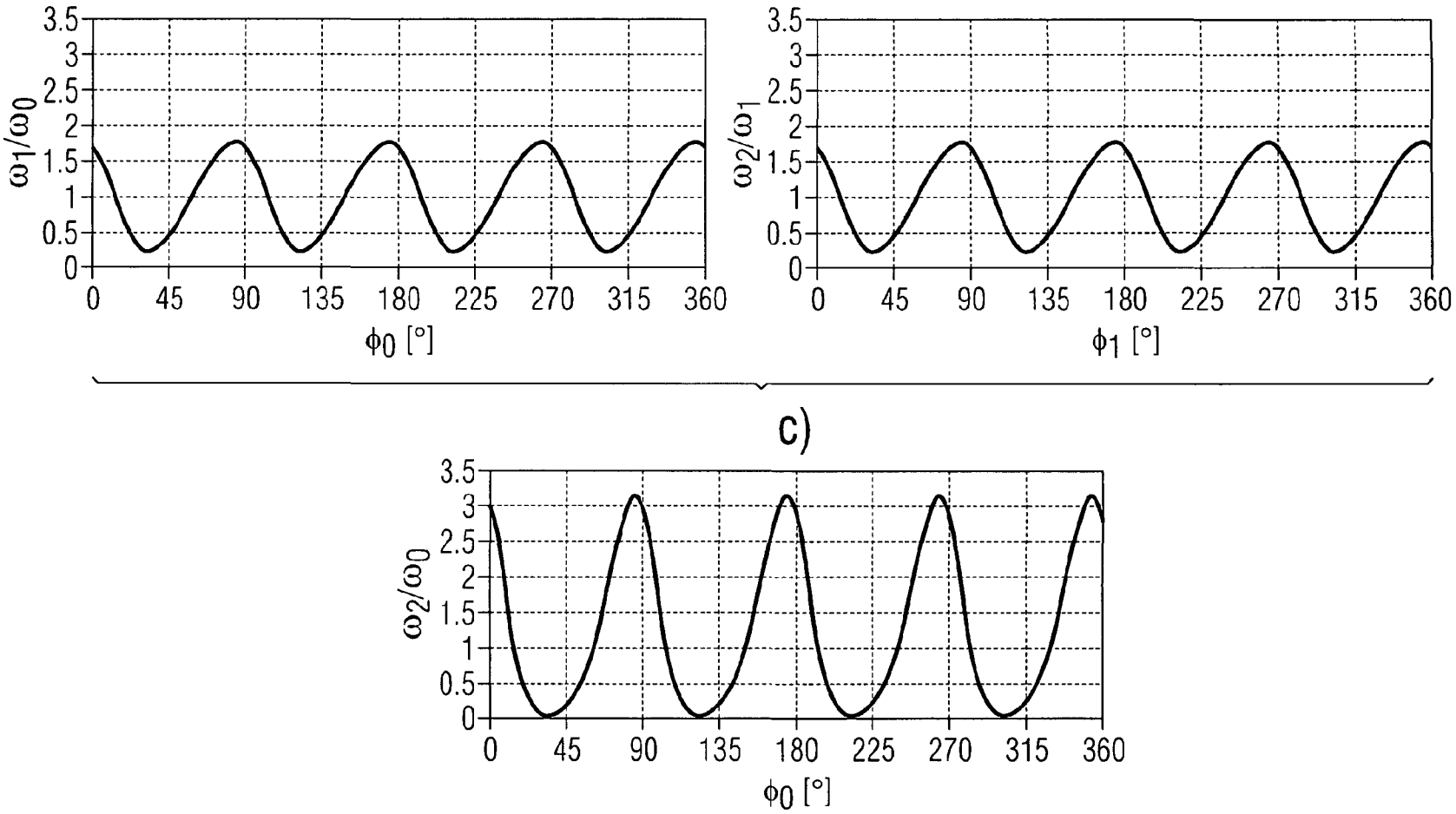
FIG. 10 depicts diagrams for explaining the operation of the kinematic transmission according to FIG. 8.

In FIG. 10 diagrams are depicted, which correspond to those of FIG. 4 with regard to the abscissa and ordinal. The figure part a) of FIG. 10 indicates the ratio between angular speed $\omega_1$ of the guide rod 42 to the angular speed $\omega_0$ of the support rod 22 in dependence on the rotational position $\Phi_0$ of the push rod 32, which ratio is determined by the eccentricity of the bearing of the push rod 32 on the first planetary gear 26.

The figure part b) indicates the ratio of the angular speed $\omega_2$ of the extension 34 to the angular speed $\omega_1$ of the guide rod 42 in dependence on the rotational position $\Phi_1$ of the guide rod 42, which ratio is given by the eccentric bearing of the push rod 44 on the second planetary gear 40.

The figure part c) indicates the ratio between the angular speed $\omega_2$ of the extension 34 and the angular speed $\omega_0$ of the support rod 22 for the case that the two angular speed changes related to the planetary gears 26 and 40 are substantially in phase and lead to maximum changes of the angular speed of the extension 34 (pump shaft) relative to the angular speed of the support rod 22 (drive shaft or crankshaft). An adjustment of the adjusting device 30 does not lead to a change of the relative positions of the two planetary gears 26 to one another, but rather only to a parallel shift of the curve according to FIG. 10*c*.

Figure 11:
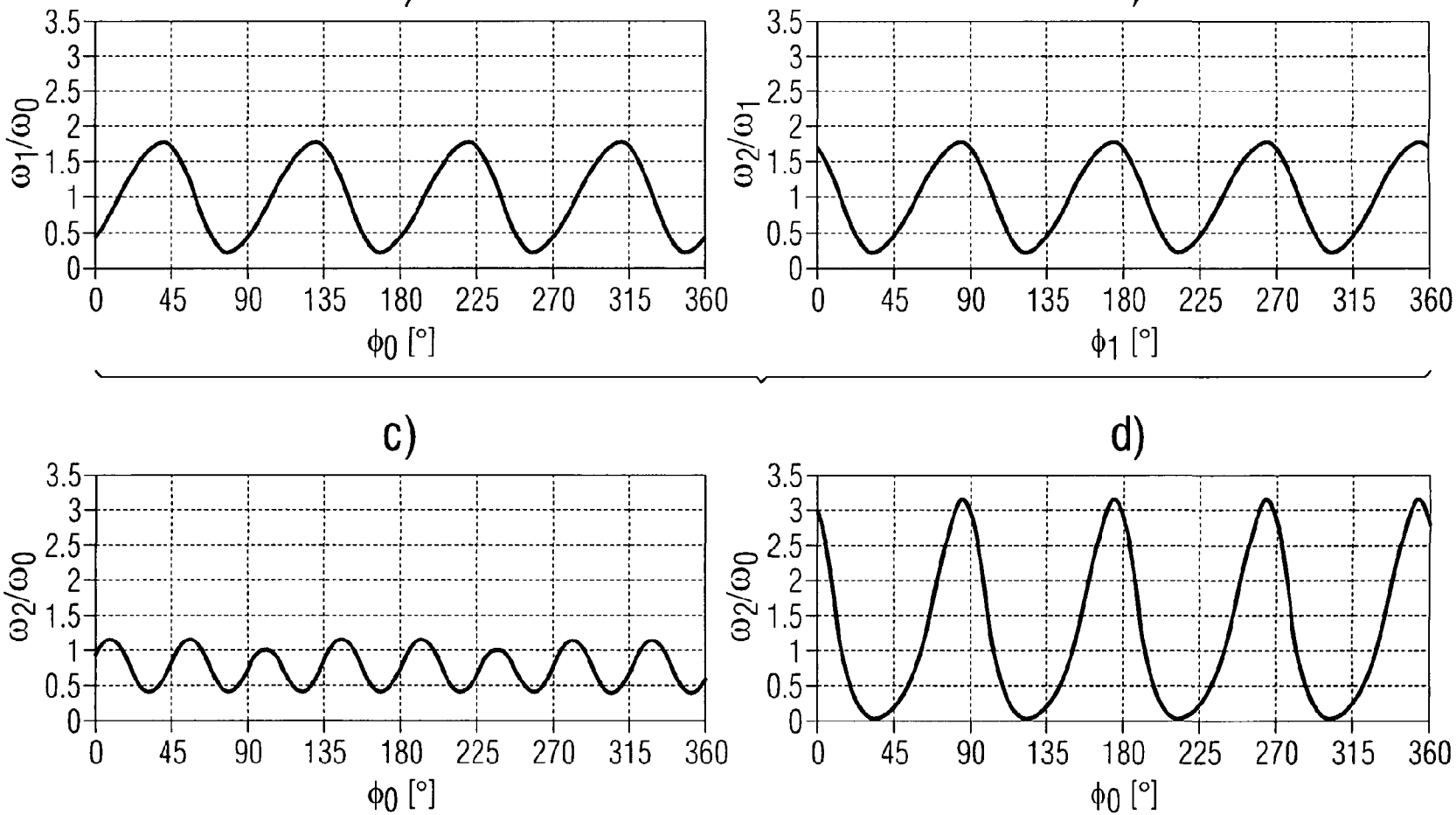
FIG. 11 depicts diagrams for explaining the operation of the transmission according to FIG. 9

FIG. 11 clarifies the functioning of the kinematic drive according to FIG. 9. In contrast to the embodiment according to FIG. 8, in the transmission according to FIG. 9 the rotational position of the second planetary gear 40 can be adjusted relative to the first planetary gear 26 using the adjusting device 48, so that the phase position of the angular speed change effected by the planetary gear 40 (FIG. 11*b*) can be changed relative to the angular speed change that is effected by the planetary gear 40.

FIG. 11*c*) indicates the change resulting from the superposition of the two angular speed changes of the angular speed $\omega_2$ of the extension 34 relative to the angular speed $\omega_0$ of the support rod 22 over the rotational position $\Phi_0$ of the support rod 22 for the case that the eccentric bearings of the push rod 44 on the planetary gear 40 and the push rod 32 on the planetary gear 26 act in opposite directions. FIG. 11*d*) indicates the case wherein the eccentricities act in phase, i.e. a maximum angular speed change is achieved.

Through a suitable choice of the values that mediate the angular speed changes, such as the eccentricities of the bearings of the push rods 44 and 32, the radial location of the linkage of the push rod 44 to the extension 34 and the relative rotational positions of the two planetary gears 26 and 40, the amplitude of the angular speed change can be reduced to a very small amount, in the ideal case so far that the angular speed of the extension 34 is constantly substantially the same amount as the angular speed of the support rod 22. The function of the adjusting device 30 of FIG. 9 corresponds to that of the other embodiments, i.e. with the adjustment device 30 the phase of the angular speed change of the extension 34 can be changed relative to the rotational position of the support rod 22. If only the adjusting device 48 is provided, the amplitude of the angular speed change can be adjusted, whereby advantageous angular speeds can be respectively set for each injection time point.

Figure 12:
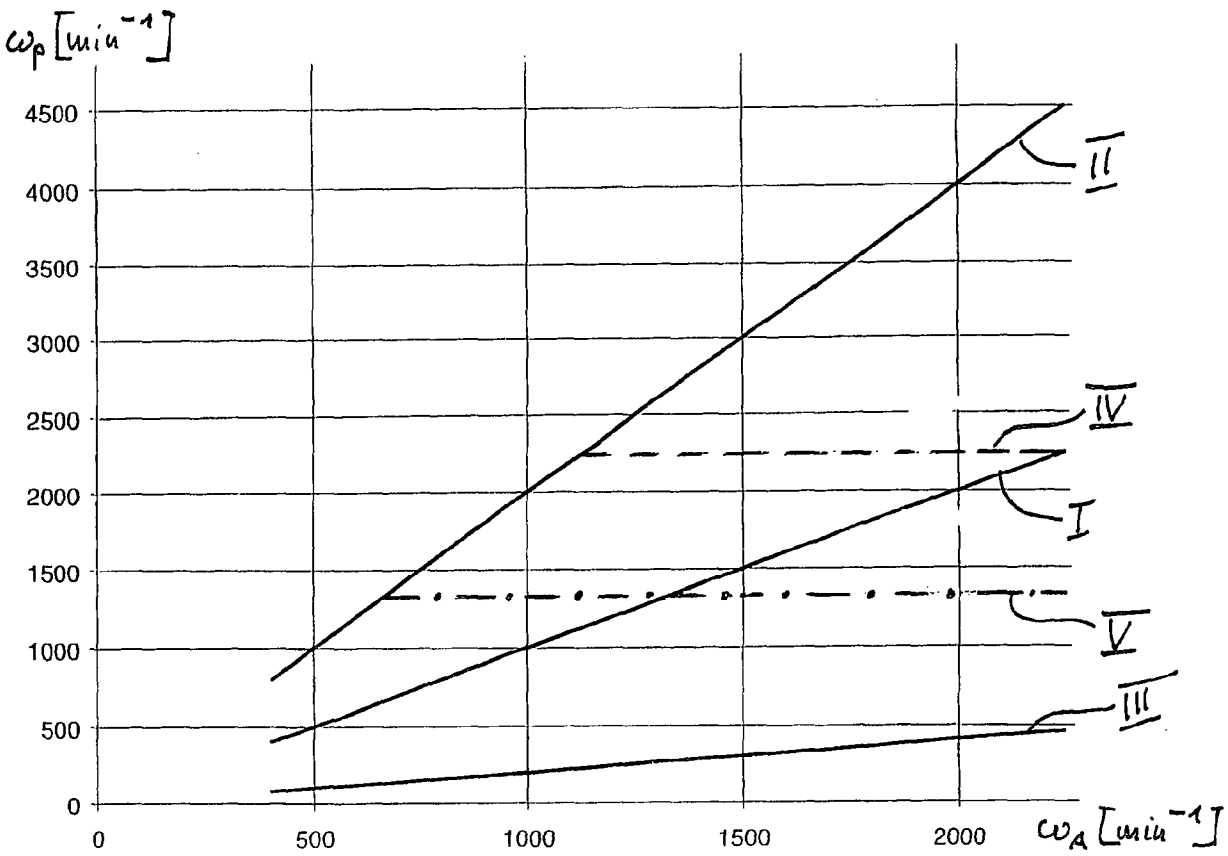
FIG. 12 depicts diagrams for the summarized explanation of possibilities created by the invention.

The curves indicated in FIG. 12 summarize the possibilities of how, through use of the invention, the angular speed $\omega_P$ of the pump shaft can be changed at the time point of a pump stroke in dependence on the angular speed $\omega_A$ and/or the rotational speed of the drive shaft. Curve I indicates the case in which the pump shaft rotates at the same angular speed as the drive shaft. Curve II indicates how, using the largest possible amplitude of the angular speed change caused by the kinematic transmission, the angular speed $\omega_P$ of the pump shaft at the time point of an injection or a pump stroke in the depicted example can respectively be made approximately twice as large as the angular speed of the drive shaft. Curve III indicates the opposite case, namely, that the angular speed $\omega_P$ relative to the rotational speed of the drive shaft at the time point of an injection is reduced to a minimum value. Curve IV indicates the case in which the angular speed of the pump shaft is held at a constant, high-as-possible value over as large as possible a rotational speed range of the drive shaft, which for example corresponds to the rated speed of an existing pump. Curve V indicates the case in which the angular speed of the pump shaft can be held at a value over as wide a possible a range of rotational speeds, which is as wide as the range of rotational speeds corresponding to curve IV, which corresponds to an average rotational speed of the drive shaft.

The Figures explain only a few examples for kinematic transmissions, which can be modified in various ways. For example in FIG. 8 in the place of the gear 28, two axially adjacent gears can be used, each of which meshes with one of the planetary gears and only one of which is adjustable. It is understood that all types of kinematic transmissions can be used, wherein the rotational speed of a uniformly rotating shaft is converted to angular speeds of a non-uniformly rotating shaft, which angular speeds fluctuate around an average angular speed. The adjusting device 30 and/or 48 for adjusting the phase can be effected electrically, hydraulically, electro-hydraulically, using centrifugal force, etc.

For the lubrication of the transmission, either an immersion oil lubrication with one-time filling and corresponding change intervals, or a spray oil supply with corresponding oil drain can be provided. For the spray oil supply, the existing engine oil circulation system of the internal combustion engine can be used.

The invention can in general be used for pumps or pump devices wherein, in dependence on the rotational position of a pump shaft, at least one outlet is loaded with supply pressure that depends on the angular speed of the pump shaft. Examples for such pumps are distributor injection pumps, in-line injection pumps as well as insertion pumps having separate camshafts for pump-line-nozzle systems.

REFERENCE NUMBER LIST

10 Disk
12 Drive means
14 Disk
16 Kinematic transmission
18 Injection pump
20 Outlets
22 Support rod
24 Axle
26 Planetary gear
28 Gear
29 Adjusting arm
30 Adjusting device
32 Push rod
34 Extension
36 Annular part
38 Shaft
40 Planetary gear
42 Guide rod
44 Push rod
46 Gear
48 Adjusting device
A Drive shaft
KW Crankshaft
P Pump shaft
M Midpoint

The invention claimed is:

1. A method for varying a duration of a supply stroke of a pump element, whose supply stroke is actuated by a rotatably-driven pump shaft over a predetermined rotational position range of the pump shaft, the method comprising:

rotatably driving the pump shaft via a drive shaft, while the drive shaft is rotating at a constant angular speed, increasing the angular rotating speed of the pump shaft at least once during one revolution of the pump shaft, and while the drive shaft is rotating at the constant angular speed, decreasing the angular rotating speed of the shaft pump at least once during the one revolution of the pump shaft wherein the angular speed of the pump shaft over a predetermined rotational position range of the pump shaft is increased when the rotational speed of the drive shaft is below a predetermined rotational speed, and the angular speed of the pump shaft over the predetermined rotational position range of the pump shaft is decreased when the rotational speed of the drive shaft is above the predetermined rotational speed, and wherein the magnitude of the increase or decrease of the angular speed of the pump shaft increases with an increasing difference between the predetermined rotational speed of the drive shaft and the instantaneous rotational speed of the drive shaft, so that the duration of a supply stroke of the pump element and/or its supply speed remains substantially constant during changing rotational speeds of the drive shaft.

2. The method according to claim 1, wherein, with increasing rotational speed of the drive shaft, the rotation of the pump shaft increasingly advances relative to the rotation of the drive shaft.

3. The method according to claim 1, wherein during the one revolution of the pump shaft, a predetermined volume of liquid is respectively loaded at equal angular intervals into a plurality of outlet conduits and the angular speed of the pump shaft during each loading is increased or decreased.

4. The method according to claim 1, wherein during the one revolution of the pump shaft, a predetermined volume of liquid is respectively loaded at equal angular intervals into a plurality of outlet conduits and the angular speed of the pump shaft during each loading is increased or decreased.

5. A pump device, comprising:

a housing having an inlet, which is connectable to a liquid supply line, and at least one outlet, to which an outlet conduit is connectable, and a pump disposed in the housing and having a pump shaft, wherein the pump is configured such that a volume of liquid is suppliable to the at least one outlet of the housing, which volume of liquid is supplied by a pump element actuated by the pump shaft over a predetermined rotational position range of the pump shaft, a drive shaft (A) configured to rotatably drive the pump shaft, and at least one kinematic transmission operative between the drive shaft and the pump shaft, the kinetic transmission being configured to both increase and decrease the angular speed of the pump shaft at least once during one revolution of the pump shaft while the drive shaft is rotating at a constant rotational speed, the kinematic transmission includes:

a gear held in a rotationally-fixed manner, a planetary gear rotatably borne on a support component, and a coupling rod having a first end eccentrically borne on the planetary gear and a second end eccentrically borne on a component, wherein the support component is connected with the pump shaft or the drive shaft so as to rotate therewith and is rotatable about an axle extending through the midpoint of the gear, and the planetary gear revolves about the gear when the support component rotates while engaging the teeth of the gear.

6. The pump device according to claim 5, further comprising:

an adjusting apparatus configured to change a phase position of the change of the angular speed of the pump shaft relative to the angular speed of the drive shaft.

7. The pump device according to claim 5, further comprising:

multiple outlets formed on the housing that, over predetermined rotational position intervals of the pump shaft, which intervals are spaced from each other at equal rotational angles, are loadable with a pressure that depends on the rotational speed of the pump shaft, wherein the kinematic transmission is configured such that the angular speed of the pump shaft changes in the same way during one revolution when each of the outlets is respectively loaded with pressure.

8. The pump device according to claim 7, wherein the outlets are configured to be connected with injection valves of an internal combustion engine and the pump device is a distributor injection pump.

9. The pump device according to claim 5, wherein the ratio between the diameters of the planetary gear and of the rotationally-fixed gear, with which the planetary gear is in engagement, is the same as the number of outlet(s).

10. The pump device according to claim 9, wherein the rotational position of the rotationally-fixed gear is adjustable.

11. A pump device, comprising:

a housing having an inlet, which is connectable to a liquid supply line, and at least one outlet, to which an outlet conduit is connectable, and a pump disposed in the housing and having a pump shaft, wherein the pump is configured such that a volume of liquid is suppliable to the at least one outlet of the housing, which volume of liquid is supplied by a pump element actuated by the pump shaft over a predetermined rotational position range of the pump shaft, a drive shaft (A) configured to rotatably drive the pump shaft, and at least one kinematic transmission operative between the drive shaft and the pump shaft, the kinetic transmission being configured to both increase and decrease the angular speed of the pump shaft at least once during one revolution of the pump shaft while the drive shaft is rotating at a constant rotational speed, wherein the kinematic transmission includes:

a gear held in a rotationally-fixed manner, a first planetary gear rotatably borne on a support component, a coupling rod having a first end eccentrically borne on the first planetary gear and a second end centrically borne on a second planetary gear, and a further coupling rod having a first end eccentrically borne at the second planetary gear and a second end borne on a component, wherein the support component is connected with the drive shaft or the pump shaft so as to rotate therewith, the component is connected with the pump shaft or the drive shaft so as to rotate therewith and they are rotatable about an axle extending through the midpoint of the gear, and the planetary gears revolve around the gear when the support component rotates while engaging in the teeth of the gear.

12. The pump device according to claim 11, wherein the kinematic transmission is configured such that an adjustment of a gear held rotationally-fixed in the direction of an advance of the pump shaft relative to the drive shaft leads to an increasing reduction of the angular speed of the pump shaft over a predetermined rotational position interval.

13. The pump device according to claim 11, wherein the ratio between the diameters of a given one of the first planetary gear and the further planetary gear and of the rotationally-fixed gear, with which the given one of the planetary gear and the further planetary gear is in engagement, is the same as the number of outlet(s).

14. The pump device according to claim 13, wherein the rotational position of the rotationally-fixed gear is adjustable.

15. The pump device according to claim 11, further comprising:

an adjusting apparatus configured to change a phase position of the change of the angular speed of the pump shaft relative to the angular speed of the drive shaft.

16. A pump device, comprising:

a housing having an inlet, which is connectable to a liquid supply line, and at least one outlet, to which an outlet conduit is connectable, and a pump disposed in the housing and having a pump shaft, wherein the pump is configured such that a volume of liquid is suppliable to the at least one outlet of the housing, which volume of liquid is supplied by a pump element actuated by the pump shaft over a predetermined rotational position range of the pump shaft, a drive shaft (A) configured to rotatably drive the pump shaft, and at least one kinematic transmission operative between the drive shaft and the pump shaft, the kinetic transmission being configured to both increase and decrease the angular speed of the pump shaft at least once during one revolution of the pump shaft while the drive shaft is rotating at a constant rotational speed, wherein the kinematic transmission includes:

a gear held in a rotationally-fixed manner, a first planetary gear rotatably borne on a support component, a coupling rod having a first end eccentrically borne on a first planetary gear and a second end centrically borne on a further planetary gear, and a further coupling rod having a first end eccentrically borne on the further planetary gear and a second end borne on a component, wherein the support component is coupled with the drive shaft or the pump shaft so as to rotate therewith, the component is coupled with the pump shaft or the drive shaft so as to rotate therewith and they are rotatable about an axis extending through the midpoint of the first gear, the first planetary gear revolves about the gear when the support component rotates while engaging in the teeth of the first gear, and the second planetary gear revolves while engaging in teeth of a second, rotationally-fixed gear having teeth concentric to the teeth of the first gear.

17. The pump device according to claim 16, wherein the ratio between the diameters of a given one of the first planetary gear and the further planetary gear and of the rotationally-fixed gear, with which the given one of the planetary gear and the further planetary gear is in engagement, is the same as the number of outlet(s).

18. The pump device according to claim 16, wherein the rotational position of at least one of the rotationally-fixed gears is adjustable.

19. The pump device according to claim 16, further comprising:

an adjusting apparatus configured to change a phase position of the change of the angular speed of the pump shaft relative to the angular speed of the drive shaft.

* * * * *

UNITED STATES PATENT AND TRADEMARK OFFICE

CERTIFICATE OF CORRECTION

PATENT NO. : 9,057,371 B2
APPLICATION NO. : 13/577767
DATED : June 16, 2015
INVENTOR(S) : Peter Kreuter It is certified that error appears in the above-identified patent and that said Letters Patent is hereby corrected as shown below:

In the claims,

Column 9, line 2-3, the phrase "shaft pump" should be changed to -- pump shaft, --

Column 9, line 25, should be amended to refer to claim 2 instead of claim 1 as follows:
-- 3. The method according to claim 2, wherein during the one --

Signed and Sealed this
Thirteenth Day of October, 2015

Michelle K. Lee

Michelle K. Lee
*Director of the United States Patent and Trademark Office*